US006642776B1

(12) United States Patent
Micheloni et al.

(10) Patent No.: US 6,642,776 B1
(45) Date of Patent: Nov. 4, 2003

(54) BANDGAP VOLTAGE REFERENCE CIRCUIT

(75) Inventors: Rino Micheloni, Turate (IT); Luca Crippa, Busnago (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/541,577

(22) Filed: Apr. 3, 2000

(30) Foreign Application Priority Data

Apr. 9, 1999 (IT) ..... MI99A0722

(51) Int. Cl.[7] ..... G05F 1/10

(52) U.S. Cl. ..... 327/539; 327/520; 327/541; 323/313

(58) Field of Search ..... 327/530, 535, 327/537, 538, 539–544, 379, 378, 513, 520; 323/304, 311, 313–315, 907, 271; 365/189.09, 226–229

(56) References Cited

U.S. PATENT DOCUMENTS 5,280,455 A * 1/1994 Kanaishi ..... 365/229
5,545,978 A * 8/1996 Pontius ..... 323/313
5,712,590 A * 1/1998 Dries et al. ..... 327/539

* cited by examiner

*Primary Examiner*—Minh Nguyen
(74) *Attorney, Agent, or Firm*—Wolf, Greenfield & Sacks, P.C.; James H. Morris

(57) ABSTRACT

Bandgap voltage reference circuit with an output voltage that remains stable in the range of a temperature of utilization. The circuit includes a first circuit block, a second circuit block, and a control circuit connected with said circuit blocks, said first circuit block including a bandgap circuit with a low power consumption, said second circuit block including a bandgap circuit with a short start up time, said control circuit suitable to control said two circuit blocks in a such way that said output voltage of said bandgap voltage reference circuit is supplied by said second circuit block at the starting of said first circuit block for a period of time and said output voltage is supplied by said first circuit block for the period of time subsequent to said period of time and that lasts until the turning off of the circuit, said second circuit block being turned off after said period of time.

14 Claims, 3 Drawing Sheets

BANDGAP VOLTAGE REFERENCE CIRCUIT

BACKGROUND OF THE INVENTION

1. Field of the Invention

The present invention relates to a voltage reference circuit. More particularly, the present invention refers to a bandgap voltage reference circuit.

2. Discussion of the Related Art

In non-volatile memories with a single supply voltage it is necessary to generate different voltage reference values inside the memory that are used in the various operations of reading, writing and erasing. Some of these voltage reference values are produced by appropriate voltage regulators to which it is necessary to provide a voltage reference that remains steady over the entire range of temperature and supply that is expected.

A circuit suitable to resolve the aforesaid problem consists in a bandgap voltage reference circuit. This guarantees the stability of the reference voltage with a degree of precision in the order of a few millivolts. It is, however, necessary to design such circuit as a function of the limitations imposed by the specifications on the operation of the same. Therefore, since current technology trends impose more and more stringent specifications regarding, for instance, power consumption and start up times, it is necessary to design a bandgap voltage reference circuit that suitably meets such requirements.

The current state of the art provides the use of a bandgap voltage reference circuit in a circuit configuration whose operating principle is shown in FIG. 1. In FIG. 1 a reference current $I_{REF}$ flows through a bipolar transistor NPN in diode connection. The base-emitter voltage $V_{BE}$ of the bipolar transistor NPN is added by means of an appropriate adder node 1 with a voltage proportional to the thermal voltage $$V_T = \frac{KT}{q}$$

thus obtaining a voltage $V_{BG}=V_{BE}+KV_T$.

Therefore it is possible to compensate the variations in temperature of the voltage $V_{BE}$ with the voltage proportional to the thermal voltage $V_T$. However such compensation is realised only in a vicinity of a value of reference temperature, while neglecting the non linear terms of the base-emitter voltage. A circuit realisation with the operating principle of FIG. 1 is illustrated in FIG. 2. Such circuit realisation includes a bipolar transistor NPN Q0, in diode connection, whose emitter terminal is grounded whereas whose collector terminal is connected with the negative terminal of an operational amplifier 2 and with an end of a resistance R2. The resistance P2 has the other end connected with the output node of the operational amplifier 2 and with an end of a resistance R1. The resistance R1 has the other end connected with the positive terminal of the operational amplifier 2 and with an end of a resistance R3, that has the other end connected with the collector of a bipolar transistor NPN Q1. The bipolar transistor Q1 is in diode connection and the emitter terminal is grounded. The voltage $V_{BG}$ in output of the operational amplifier 2, ideal assumption, is given by the sum of a base-emitter voltage of the bipolar transistor NPN Q0 and of the voltage on the resistor R2. By taking advantage of the specifications of the ideal operational amplifier 2, a voltage $V_{BG}$ is obtained that is given by the following ratio:

$$V_{BG} = V_{BEO} + V_T \frac{R1}{R3} \ln \frac{R1A1}{R2A0}$$

In this expression the terms RI, R2, R3 represent opportune resistances while the terms $A_1$ and $A_0$ are the areas of the bipolar transistors Q1 and Q0.

However, both this type of circuit configuration of the bandgap as well as the other existing circuit configurations used inside non volatile memory devices, do not allow to meet simultaneously the requirements for low power consumption and for short start up times. In fact some bandgap circuits allow to reach power consumption around 2 $\mu$A but with start up times higher than 50 $\mu$s while other types of bandgap circuits allow to reach short start ups times, 300 ns, but with a high power consumption, 300 $\mu$A.

SUMMARY OF THE INVENTION

In view of the state of the art herein described, object of the present invention is to realise a bandgap voltage reference circuit that has both low power consumption as well as short start up times.

According to the present invention, this and other objects are attained by means of a bandgap voltage reference circuit with an output voltage that remains steady within the range of a temperature of utilization that comprises a first circuit block, a second circuit block, and a control circuit connected with said circuit blocks, said first circuit block comprising a bandgap circuit with a low power consumption, said second circuit block comprising a bandgap circuit with a short start up/start up time, said control circuit being suitable to manage said two circuit blocks in a such way that said output voltage of said bandgap voltage reference circuit is supplied by said second circuit block at the starting of said first circuit block for a period of time and said output voltage is supplied by said first circuit block for the period of time subsequent to said period of time and that lasts until the turning off of said circuit, said second circuit block being turned off after said period of time.

Owing to the present invention it is possible to realise a bandgap voltage reference circuit that has both low power consumption as well as short start up times.

BRIEF DESCRIPTION OF THE DRAWINGS

The characteristics and the advantages of the present invention will become evident from the following detailed description of an embodiment thereof, that is illustrated as a non limiting example in the enclosed drawings, in which.

DETAILED DESCRIPTION

Figure 1:
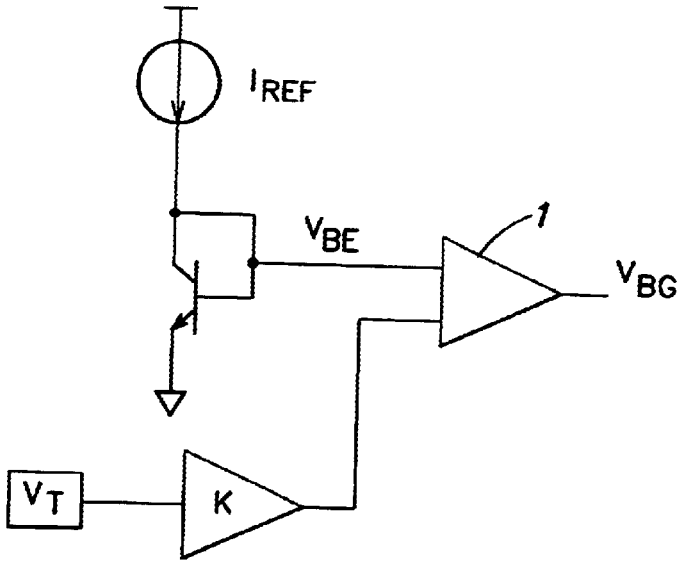
FIG. 1 (PRIOR ART)
FIG. 1 is a schematic diagram that illustrates the operating principle of a bandgap voltage reference circuit according to the known art.
Figure 2:
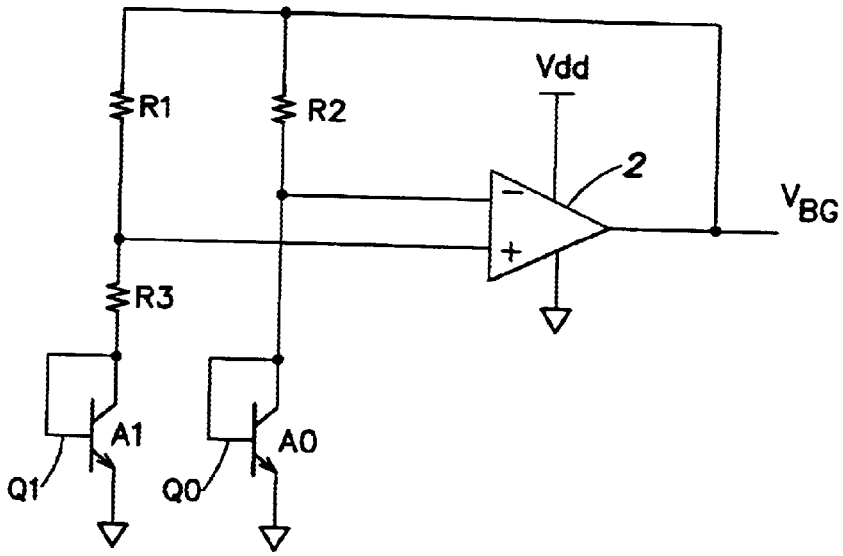
FIG. 2 (PRIOR ART)
FIG. 2 shows a circuit configuration of the circuit in FIG. 1, according to the known art.

With reference to the enclosed figures and mainly to FIG. 2, it is possible to ascertain that the output voltage of the bandgap voltage reference circuit depends only on the physical parameters of the bipolar transistor and on the course of its polarization power. In fact the output voltage $V_{BG}$ can be rewritten in the following way:

$$V_{BG}(T) = V_{G0} + V_T(\gamma - \eta) - V_T \ln\left(\frac{T}{T_0}\right)$$

In this expression by $V_{G0}$ we indicate the value of the bandgap voltage of silicon (typically 1,120 V at a temperature of 300 K), by $\eta$ the degree of dependence of the polarization power of the bipolar transistor on the temperature, instead by $\gamma$ we indicate a parameter that takes into account the dependence on the temperature both of the intrinsic concentration of the free carriers in the semiconductor, as well as of the constant of average diffusion for the electrons.

Figure 3:
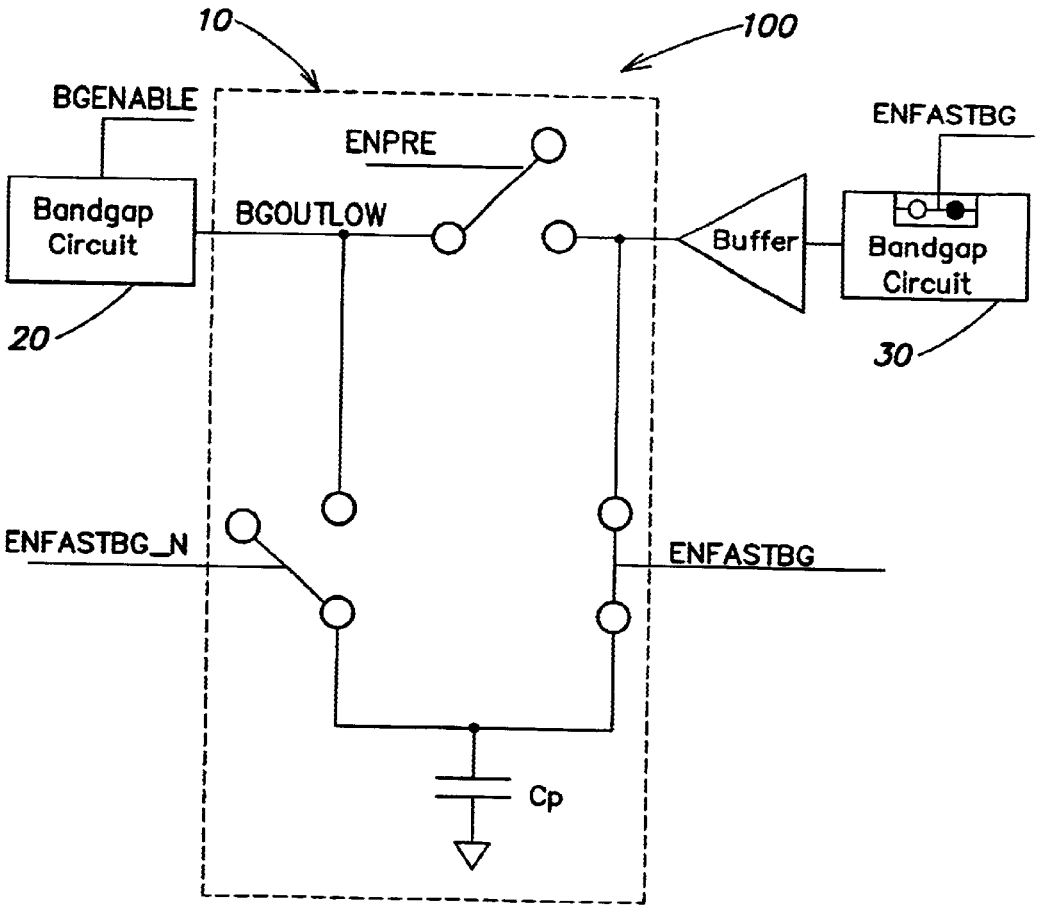
FIG. 3 is a schematic diagram that illustrates the operating principle of a bandgap voltage reference circuit according to the present invention.
Figure 4:
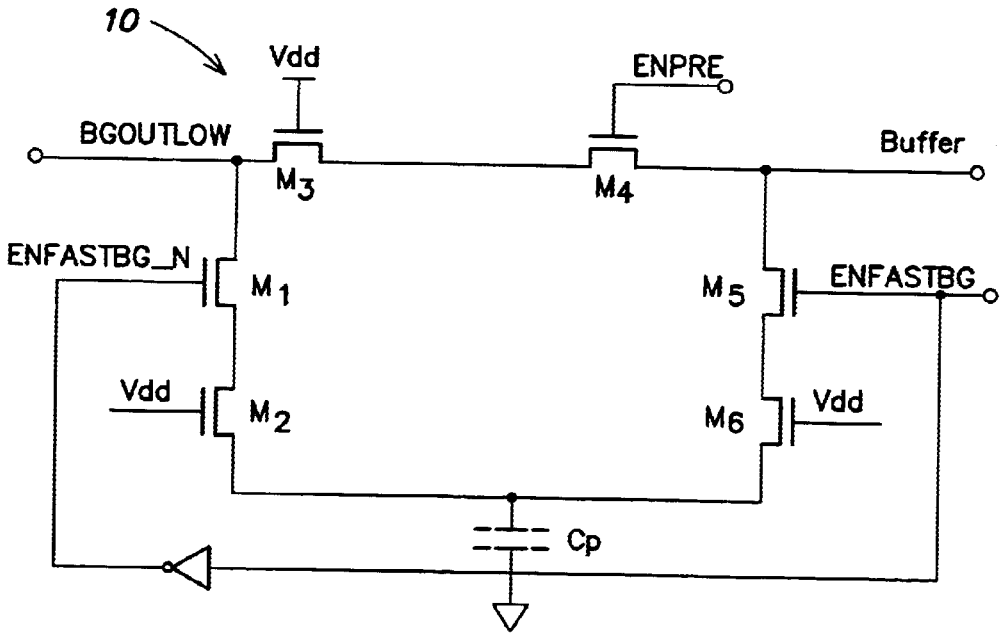
FIG. 4 shows a circuit configuration of the block 10 in FIG. 3, according to the present invention.

A first embodiment of the voltage reference circuit according to the present invention is shown in FIG. 3. In the Figure the circuit 100 is made up of a first block 20 that is connected with a circuit 10, which is in turn connected to a second block 30 by means of a buffer. The block 30 represents a bandgap circuit with a topology equal to the circuit of FIG. 2, but with a high power consumption and a very short start up time. The block 20 represents a bandgap circuit of the type in FIG. 2, but with a low power consumption and a long start up time. The two bandgap circuits 20,30 are compensated in the vicinity of the same reference temperature and they have bipolar transistors that are made by means of the same technology. The output voltages of the two bandgap circuits 20,30 are therefore theoretically identical; in fact, possible differences between them are to be ascribed to the non ideal nature of the two operational amplifiers being used. The block 10 is made up of a control circuit, shown in greater detail in FIG. 4, that controls the operation of the bandgap circuit 100. The control circuit 10 is made up of some transistors NMOS, used as switches, whose gates are controlled by voltage signals that are generated by an appropriate circuit suitable to detect the presence of the supply voltage Vdd. A signal ENFASTBG, that controls the gate the of the transistor NMOS $M_5$, enables the circuit 30 for a very short time ($\Delta t$), for instance 1 $\mu$s, at the starting of the circuit 100; in this way it is possible to prevent wasting power in the event the bandgap circuit 100 should be used for a long time. The circuit 30 will not be enabled until the next starting of the circuit 100. The signal BGENABLE enables the circuit 20, maintaining it always on. The signal ENPRE, that controls the transistor NMOS $M_4$, allows to precharge the output node of the circuit 20 at a regime value by means of the circuit 30. The signal is activated during the period of start of the circuit 100 for a very short time, for instance 800 ns, and in the remaining period of time, about 200 ns, the circuit 20 eliminates the disturbances that are present on the output voltage of the same, such disturbances being caused by the commutation of the transistor MOS $M_4$ that allows the precharging of the circuit 20. In order to allow a rapid settlement of the reference output voltage of the circuit 100, the parasitic capacitor Cp is disconnected by the node BGOUTLOW by means of the transistor NMOS $M_1$ that is controlled by the signal ENFASTB_G that represents the inversion of signal ENFASTBG. A very short time after the instant of tie starting of the circuit 100, for instance 1 $\mu$s, the circuit 20 settles around its regime value; it is therefore possible to connect to the circuit 20 with the capacitor Cp by means of the activation of the signal ENFASTBG_N, and, at the same instant, it is possible to turn off the circuit 30 by means of the signal ENFASTBG. The voltage $V_{BG}$ in the output of the circuit 100 will be given by the output voltage of the circuit 30 for a period of time ($\Delta t$) and by the output voltage of the circuit 20 for a period of time subsequent to the period of time $\Delta t$ and that lasts until the turning off of the circuit 100. The NMOS transistors $M_2$, $M_3$, and $M_6$ have their gates connected with the supply voltage in order to avoid generating disturbances on the reference voltage due to the capacitive couplings that take place during the commutations of the transistors.

Figure 5:
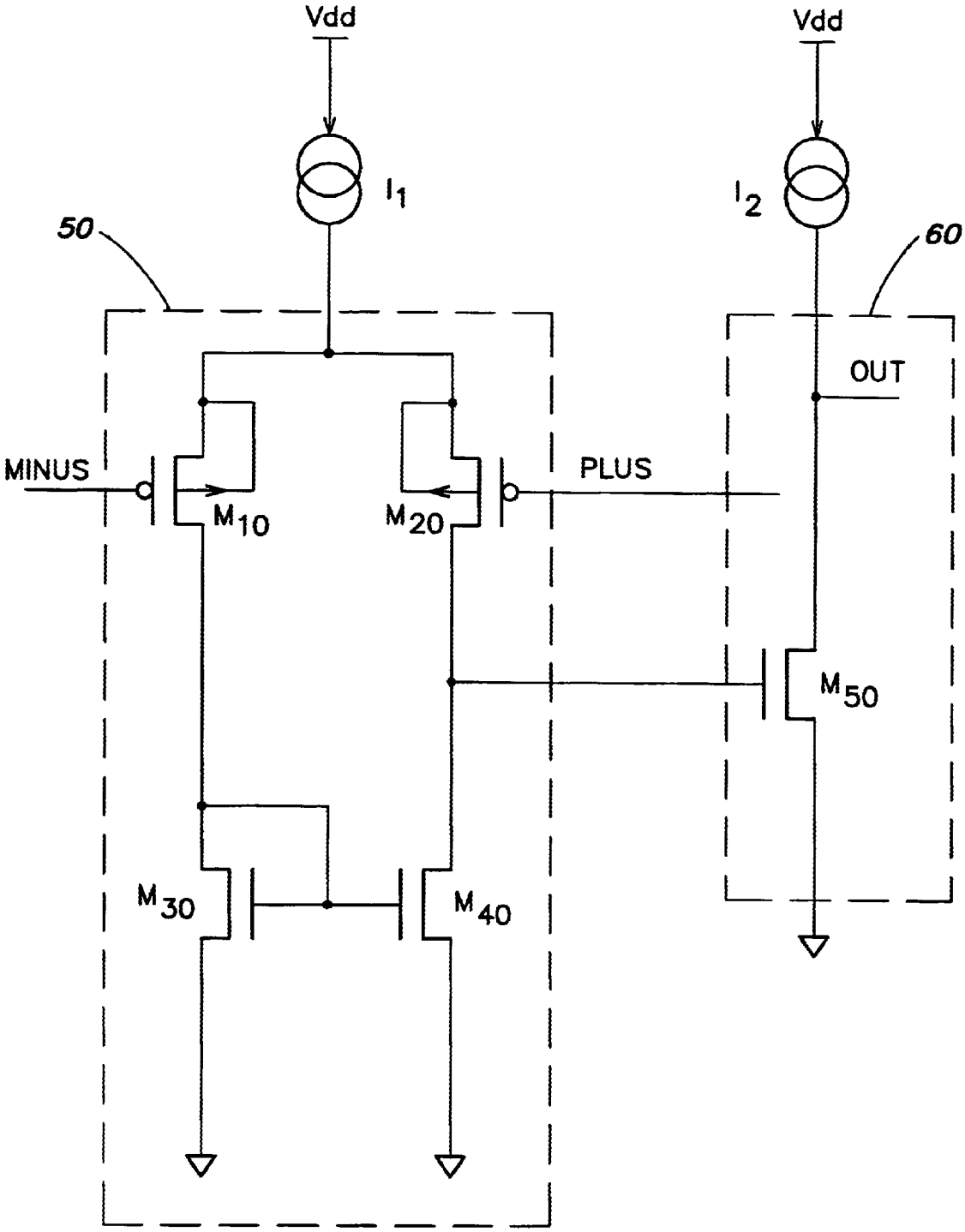
FIG. 5 shows a circuit configuration of the operational amplifier in FIG. 2, according to the present invention.

It is necessary and essential for the reference bandgap circuit 100 to correctly size the two operational amplifiers that are present in the circuit configuration of the same. It is necessary that the non ideal components of the two operational amplifiers have little influence on the output voltage of the circuit 100, therefore it becomes necessary to adopt a circuit configuration of an operational amplifier as the one shown in FIG. 5. In FIG. 5 there is described a trasconductance operational amplifier comprising a first stage 50 and a second stage 60. The first stage 50 is comprises a differential stage consisting in the two transistors PMOS $M_{10}$, $M_{20}$, whose gates are controlled by the signals input into the operational amplifier, and by a power mirror consisting of the two transistor NMOS $M_{30}$, $M_{40}$. The second stage 60 consists of a transistor NMOS $M_{50}$, in common source configuration in order to be able to considerably amplify the signal deriving from the first stage 50. The differential stage includes the two transistor PMOS $M_{10}$, $M_{20}$ because the voltage signals in input to the operational amplifier are in the range of the Vbe. The second stage 60 is made up of a transistor NMOS in order to obtain a reference voltage that little depends on the supply voltage. In addition transistors $M_{10}$, $M_{20}$ and $M_{50}$ are designed with a high form factor (W/L) in order to increase the gain of the operational amplifier 2.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. Bandgap voltage reference circuit with an output voltage that remains stable in the range of a temperature of utilization comprising a first circuit block, a second circuit block, and a control circuit connected with said circuit blocks, said first circuit block comprising a bandgap, circuit with a low power consumption, said second circuit block comprising a bandgap circuit with a short start up time, said control circuit to control said two circuit blocks such that said output voltage of said bandgap voltage reference circuit is supplied by said second circuit block at the starting of said bandgap voltage reference circuit for a first period of time and said output voltage is supplied by said first circuit block for the period of time subsequent to said first period of time and that lasts until the turning off of said bandgap voltage reference circuit, said bandgap voltage reference circuit further comprising a first switch to turn off said second circuit block after said first period of time.

2. Circuit according to claim 1, wherein said control circuit is made up of second switches including transistors NMOS.

3. Circuit according to claim 2, wherein said transistors NMOS of said control circuit are controlled by control signals.

4. Circuit according to claim 3, wherein said control signals include a first signal that controls the gate of a fifth transistor NMOS to enable the second circuit block for said first period of time, during the period of start up of said bandgap voltage reference circuit, a second signal that controls the gate of a fourth transistor NMOS that allows to precharge the output node of the first circuit block at regime value by means of said second circuit block, said second signal being activated during the period of start up of the bandgap voltage reference circuit for a period of time shorter than said first period of time, in order to allow the prevention of the disturbances present on the output voltage of said first circuit block in the remaining time, and a third signal, that is the first signal inverted, that controls the gate of a first transistor NMOS to connect said first circuit block with a capacitance simultaneously to a disabling of said second circuit block by means of said first signal.

5. Circuit according to claim 4, wherein each one of said circuit blocks has a circuit configuration including a first bipolar transistor NPN, in diode connection, having an emitter terminal that is grounded and having a collector terminal that is connected with the negative terminal of an operational amplifier and with an end of a first resistance, said first resistance having the other end connected with the output node of said operational amplifier and with an end of a second resistance, said second resistance having the other end connected with the positive terminal of said operational amplifier and with an end of a third resistance, said third resistance having the other end connected with the collector of a second bipolar transistor NPN, said second bipolar transistor having a diode connection and the emitter terminal grounded.

6. Circuit according to claim 5, wherein said operational amplifier comprises a first stage of amplification and a second stage of amplification, said first stage being formed of a differential stage including a first and a second transistor PMOS whose gate are controlled by the signals in input to the operational amplifier, and by a power mirror including a third and a fourth transistor NMOS, said second stage being formed of a fifth transistor NMOS, said fifth transistor in common source configuration in order to considerably amplify the signal deriving from the first stage, said first transistor, said second transistor and said third transistor being designed with a high form factor in order for said amplifier to have a high gain.

7. Circuit according to claim 6, wherein said fifth transistor is connected in series with a sixth transistor, said fourth transistor is connected in series with a third transistor and said first transistor is connected in series with a second transistor, wherein the gates of said second transistor, third transistor, and sixth transistor are controlled by a supply voltage in order to prevent generation of disturbances on a reference voltage of the bandgap voltage reference circuit.

8. A bandgap voltage reference circuit comprising a first bandgap circuit, a second bandgap circuit having a power consumption lower than a power consumption of the first bandgap circuit, and a control circuit connected to the first bandgap circuit and the second bandgap circuit, wherein the control circuit selects the first bandgap circuit to supply an output voltage of the bandgap voltage reference circuit for a first period of time and the control circuit selects the second bandgap circuit to supply the output voltage of the bandgap voltage reference circuit for a second period of time subsequent to the first period of time, and wherein the bandgap voltage reference circuit further comprises a switch that, responsive to a control signal, turns off the first bandgap circuit after the first period of time.

9. The circuit of claim 8, wherein the first period of time begins at a startup of the bandgap voltage reference circuit.

10. The circuit of claim 8, wherein the first bandgap circuit has a shorter startup time than a startup time of the second bandgap circuit.

11. A bandgap voltage reference circuit comprising a first bandgap circuit, a second bandgap circuit having a startup time shorter than a startup time of the first bandgap circuit, and a control circuit connected to the first bandgap circuit and the second bandgap circuit, wherein the control circuit selects the second bandgap circuit to supply an output voltage of the bandgap voltage reference circuit for a first period of time and the control circuit selects the first bandgap circuit to supply the output voltage of the bandgap voltage reference circuit for a second period of time subsequent to the first period of time, and wherein the bandgap voltage reference circuit further comprises a switch that, responsive to a control signal, turns off the second bandgap circuit after the first period of time.

12. The circuit of claim 11, wherein the first period of time begins at a startup of the bandgap voltage reference circuit.

13. The circuit of claim 11, wherein the first bandgap circuit has a lower power consumption than a power consumption of the second bandgap circuit.

14. A method for generating, with a short start up time and low power consumption, a bandgap reference voltage, the method comprising acts of:

selecting, from a plurality of bandgap circuits, a bandgap circuit having a shortest startup time to provide the bandgap reference voltage for a first period of time;

selecting, from the plurality of bandgap circuits, a bandgap circuit having a lowest power consumption to provide the bandgap reference voltage for a second period of time subsequent to the first period of time; and turning off the bandgap circuit having the shortest startup time after the first period of time.

* * * * *